US010821349B1

(12) United States Patent
Hakimi

(10) Patent No.: US 10,821,349 B1
(45) Date of Patent: Nov. 3, 2020

(54) TRAINING AND AIMING DEVICE FOR CUE SPORTS

(71) Applicant: Navid Hakimi, Toronto (CA)

(72) Inventor: Navid Hakimi, Toronto (CA)

( * ) Notice: Subject to any disclaimer, the term of this patent is extended or adjusted under 35 U.S.C. 154(b) by 0 days.

(21) Appl. No.: 16/577,845

(22) Filed: Sep. 20, 2019

(51) Int. Cl.
*A63D 15/00* (2006.01)
*A63D 15/08* (2006.01)

(52) U.S. Cl.
CPC ..... *A63D 15/006* (2013.01); *A63D 15/08* (2013.01)

(58) Field of Classification Search
CPC ..... A63D 15/006; A63D 15/08; A63D 15/105
USPC ..... 473/2
See application file for complete search history.

(56) References Cited

U.S. PATENT DOCUMENTS 2,869,262 A * 1/1959 Lucas ..... G09F 21/045 40/587
5,078,400 A * 1/1992 Desbiolles ..... A63B 53/04 473/349
5,554,075 A * 9/1996 Glazer ..... A63D 15/006 473/2
5,738,595 A * 4/1998 Carney ..... A63B 69/3614 33/290
8,944,931 B2 * 2/2015 Nell ..... A63B 69/3608 362/191
2005/0116815 A1 * 6/2005 Chen ..... F41G 1/35 340/331
2006/0186726 A1 * 8/2006 Cannon ..... B60B 7/20 301/37.26
2007/0082325 A1 * 4/2007 Novosel, Sr. ..... A63B 69/3608 434/252
2008/0090670 A1 * 4/2008 Liu ..... A63D 15/006 473/2
2009/0143156 A1 * 6/2009 Schulze ..... A63D 15/105 473/46
2011/0201436 A1 * 8/2011 Robinson ..... A63D 15/10 473/42
2016/0059110 A1 * 3/2016 St-Yves ..... A63D 15/08 473/2
2016/0305634 A1 * 10/2016 Cheung ..... F21V 14/025
2018/0272412 A1 * 9/2018 Bazerkanian ..... B21D 53/32
2018/0288204 A1 * 10/2018 Nahum ..... H04M 1/04

FOREIGN PATENT DOCUMENTS

GB 2276825 A * 10/1994 ..... A63D 15/006

OTHER PUBLICATIONS

Steven Gordon, YouTube video titled "pool cue cam", published Mar. 22, 2009, www.youtube.com/watch?v=IL_b_RRF2Dg (Year: 2009).*

* cited by examiner

*Primary Examiner* — Laura Davison
(74) *Attorney, Agent, or Firm* — Nasser Ashgriz; UIPatent Inc.

(57) ABSTRACT

The present invention is a training device that helps the players of cue sports to realize their mistakes and improve their skills. The device comprises of a laser module that can be placed onto the cue to emit a line laser on the cue ball, the target ball and the playing surface or ground as an aiming guide. The device comprises of a self-balancing system to automatically hold the laser on top of the cue for a proper beam. The device further comprises of a control board to program different duty cycles and coaching scenarios of the device.

15 Claims, 11 Drawing Sheets

TRAINING AND AIMING DEVICE FOR CUE SPORTS

FIELD OF THE INVENTION

The present invention relates in general to training aids in planar sports and in particular to cue sports training and practice.

BACKGROUND OF THE INVENTION

Planar sport is a sport that the movement of the object (ball, pot, disc, etc.) happens predominately on a surface and the vertical aspect of the movement of the object is of secondary important. These sports can include but not limited to sports such as Billiards, Snooker, Golf, Hockey, Curling, Bowling, etc. The critical aspect in all these sports is that an object such as a ball, a disc, a pot, etc. needs to be delivered, shot, thrown, etc. to an aim such as a goal, a basket, a hole, etc. or passed to a teammate. The ability to perform well in the mentioned sports is predominately evaluated by the accuracy of the delivery.

The Cue sports (billiard, snooker, etc.) are a wide variety of games of skill which are played with a cue stick (billiard stick). The cue is held by the hand of a player and is used to strike billiard balls (cue balls) in order to move them on a cloth-covered billiard table (snooker table or pool table) which is bounded by elastic bumpers (cushions).

There are two main components to a successful strike of the cue ball that the players need to pay attention and they seek improvements in their regards. "The aiming", which is the precise placement of the cue on to the desired path of the cue ball to be taken by the cue ball after being struck by the cue, and "the delivery", which is a technical term describing the quality of the movement of the cue prior to, during the strike, and right after the strike (i.e. follow through).

During the aiming process, the player picks a point that they want the cue ball to hit (point of impact) after being struck. In the most simple form, they want the cue ball to go through a straight path from the cue ball's current position to the desired point, where it hits the target, which can be another ball, a cushion, or a desired hypothetical point imagined on the table by the player. The straight line that connects the center of the cue ball from its resting position to the desired location is called "line of aim". Placing the cue precisely on to the line of aim is often challenging for players with various levels of expertise.

Finding the target point is a first step which is relatively straightforward. Placing the cue exactly onto the line of aim is the most struggling matter which the players struggle with no matter how is their expertise.

The second critical aspect in cue sports is "delivery". Delivery is a technical term that comprise the act of hitting the cue ball with the cue. After the cue is placed on the line of shot, the cue is moved towards the cue ball by the player to hit the cue ball and send it towards the aim. The direction that the cue ball travels when struck by the cue is the same direction of the force that is exerted to it, which is the same direction of the cue movement during the hit. In other words, in the simplest form, the direction of the travelling cue is the same direction that the cue ball takes towards the target. The players are thus motivated, and it is desired that they keep the cue as straight as possible on the line of shot when striking the cue ball. If they deflect from the straight line of shot when hitting the cue ball, the force that is exerted on to the cue ball will not be on the same direction as the line of aim, and thus the cue ball will travel in a non-desirable direction. What separates good players from mediocre players, and what is the most essential skill during playing cue sports, is thus the delivery, and moving the cue in such a way that remains on the line of aim when hitting the cue ball.

The fact that the cue should remain on the line of aim and not deflect from the line of aim during the delivery and the hitting motion is a key component of a successful strike and one that is obvious to the players with various degree of expertise. To achieve this, most players relax their shoulder and their hand muscles (grip muscles) and they restrict the movement of various joints in the shoulder and their hand grip, and only use the elbow joint, which is considered a one dimensional hinge joint to play the shot. The experts call this type of shot "hitting from the elbow". It is believed that any movement except from the elbow joint, can cause deflections to the path of the cue. If the cue is rotated during the delivery along its longitude axis, there is a strong indication that such a movement has happened (a movement along a joint that is not the elbow joint). When such deflections happen, usually the quality of the shot deteriorates, and experts try hard to avoid this rotational movement during the delivery. However, this kind of rotation is notoriously difficult to detect for novice players.

Various devices have been disclosed to solve the indicated issues. These devices fall into two categories. The first category is where a laser dot or optical system is used on the cue or in the tip of the cue. This device can only illuminate the object ball or the cue ball at any given time. There is a considerable amount of guess work and imagination involved when using a regular laser dot that only illuminated one point at a time. If the optical system is placed on top of the cue, it only works and correctly shows the direction if the cue is held in a very particular manner, namely, if it is held in an upright position where the laser is furthest from the table. The idea of using a laser for aiming is nothing new. It is widely used in different scenarios as well as in sports for rifles and archers. The idea is previously adopted for cue sports too. So, it was not obvious to use a laser line generator mounted on the cue as an aiming method for cue sports. In some sports two dot lasers or an adjustable laser is used for aiming which has its own drawbacks. The distances between the cue ball and the object balls can be from a couple of centimeters to several meters depending on the position of the balls on the table. Using two lasers needs constant adjusting of the lasers according to the positions of the balls before each shot.

The second category is systems that use laser or projectors from somewhere else than the cue itself, either from the ceiling or from the side cushions. This system can be used to show the proper line of aim, but it does not reveal real time information from the delivery of the cue and does not show cue rotation, vibrations, where on the cue ball the player is hitting and if they are putting unwanted side spin. It also fails to show cue rotation while playing, which is of central importance for a good delivery. These methods rely on a big and expensive setup that is not affordable for many players, and it is not likely to be used by individuals. Rather, it is more likely to be implemented by club owners. They cannot be used for personal practice off that table, like at home.

Using line pattern instead of the dot pattern makes the line of shot fully defined and visualized. However existing methods, a line is shown from the top of the table. Image processing of sensor input is used to judge the position and orientation of the cue and the balls on the table, and a line is shined from the top perpendicular down on the table that tracks the direction of the cue. For applying this method, an especial billiard table must be built and equipped with all the necessary projectors and sensors.

Moreover, the existing method that shines the light from above cannot track the orientation of the cue along its central axis and treats all orientation the same. The especial projected light cannot be used in home or on ordinary surfaces because the necessary instruments involved. It is much less sensitive to small vibrations and subtle rotation of the cue, which are very important in quality of the shot while playing a long shot for example on a snooker table. Moreover, it does not show the position of impact on the cue ball because it is 2D projection from above. The position of impact on the cue ball will result on spins on the cue ball (top spin, screw spin, etc.) and has very important consequences on the positional play, which cannot be determined from the sensors placed perpendicularly above the table.

SUMMARY OF THE INVENTION

The present invention is a training and aiming device for cue sports and games, such as billiard. The device provides synchronized visual feedback to the players, which allows realization player's mistakes, enables faster learning, and improves player's skills. This device helps with both the aiming skills and the delivery skills. It is basically, a novel coaching system for planar and cue sports. The distinction between finding the target, and precisely placing and maintaining the cue on to the line of aim before, during the contact, or after hitting the ball, is key to understanding this invention.

The device comprises of a laser module to emit a laser sheet or linear or a cross pattern. The ability to shine such a pattern might be achieved by but not restricted to using a laser pointer and placing a line or sheet generator or cross generator lens in front of the laser. Such lenses might be but not limited to a plastic PMMA lens, glass cylindrical lens, or Powel lens. The line width and emission angle of the laser line generator can be tuned to emit a line or a sheet with a desired width and length on the playing surface or ground.

The laser should be placed in such a way that in the normal striking position, it shines a line onto a ground or a playing field or surface for aiming guide and practice in snooker and other cue sports. The force that is exerted on the ball is exactly in the same direction as the direction of laser exposure. In this scenario, after striking the ball, the ball moves on the direction that the line is showing.

The laser generator is placed in a laser holder module, which in turn will be mounted on the cue or any playing stick. The laser holder is placed in a place that does not interfere with regular play. For most cue sports, this place is around ¼ to ½ of the cue length from its tip. This place is chosen such that it is far enough from the tip to allow regular bridge formation and cueing, but not too far to interfere with the placement of the head on to the cue for sighting.

The laser holder is designed in such a way that when it resides onto the cue, it places the laser line generator or cross pattern generator at slightly higher height than the tip of the cue itself, from 1 cm to 5 cm higher. When the cue is held, for striking, usually it is held at a slight degree with respect to the table, with the tilt angle ranging from a few degrees to tens of degrees. Since the laser line generator is placed at slightly higher place as the tip and it is tilted downward, it will shine the line pattern both on to the cue ball and the target ball.

The device provides a self-balancing system to automatically balance the laser line to shine in a proper manner. A suspension system in the form of a bearing, ball bearing, or other suspension systems is provided to the inner portion of the ring of the holder to enable the cue to adjust inside the holder. A counterweight balancing system is provided on the bottom of the ring to enable the holder to remain upright on the cue. This orientation will be maintained no matter how the cue is initially held, because the counterweight always pulls on to the holder and the laser which is placed oppositely from the counterweight will go to the top of the rotation and stays there. the counterweight automatically balances the laser to shine the laser line in the proper fashion.

The self-balancing system of the holder orients the laser properly and effortlessly before, during the contact, or after hitting the ball in every shot. This will be achieved by the design parameters of the bearing and the weight. Without the self-balancing holder, the illuminated line will not coincide with the line shot or the trajectory of the cue ball after being hit by the cue. Manually orienting the laser can be flawed, tedious, and inaccurate because of misjudgment of the player. However, the self-balancing holder orients the laser properly and effortlessly on every shot. Without the counter balance system, the player is required to hold the cue in such a way that the holder remains at the top of the cue so that the line that it shines on the table be perpendicular to the table and be in the direction straight from the cue at the upper most position. If the laser is not at the top, the line that is illuminated on the table is not in the same direction as the line from the center axis of the cue, so it does not represent the direction of force that the cue is applying to the cue ball when striking it. This device shows exactly what direction is the cue aiming by simultaneously shining the line on the cue's central axis, the cue ball, the table, and the target ball, and shows that if the aim coincides with the center of the cue ball and the target. If only the cue ball or the target ball was illuminated by light it would be difficult to judge that the direction of the cue is correct. However, when both the cue ball and target ball are illuminated at the same time, it is very easy to judge to correctness of the aiming.

The present invention provides a control board to provide power to the system via a rechargeable battery and can detect the tilt angle of the device via using a tilt sensor, or an inertial measurement unit (IMU). The control board is equipped with sensors that can detect the orientation of the cue and can be programmed in such a way that turns on the laser and turn it back based on the sensor input.

The control board is intended to be programmable in such a way that enables different duty cycles based on preprogrammed software or based on the players movement which is recorded and analyzed using an IMU. By tuning the duty cycles or on-and-off periods of the laser, the control board enables using different coaching scenarios. In each coaching scenario, the player is advised to coordinate their movement of hand and thus movement of the cue to match the laser on and off periods. For example, when the laser is on, the cue should go forward and when the laser is off the cue should be drawn backward.

Furthermore, the input data from the IMU sensor can be coordinated with the laser in such a way that the laser turns on when the cue is moving forward and is turned off when the cue is withdrawn (back swing) or vice versa. This coaching scenario is designed to train the sighting of the player with the steady eye phenomena. In other words, it guides the players eye to concentrate on a particular point on each movement of the cue during the pre-shot routine In another embodiment a cross pattern lens can be used as a laser generator module comprising of two perpendicular lines. At the correct position, one line is vertical which is the same line of aim and the other line is horizontal. The horizontal line shows the level of the cue and can be used as additional feedback for the orientation of the cue along its long axis. Moreover, hitting position will always be a constant offset of the center of the cross where horizontal line and vertical line meet. This additional mark on the cue ball can be used to decide where on the cue ball to hit and adjust the level of the cue so that the desired effect (whether a top spin or screw back shot) is transferred to the cue ball.

In operation the players are often advised to remain on the shot immediately after playing the shot to check if they have played the shot correctly and the ball is following the desired trajectory. By using the laser line in combination with the balance system, if the shot is played correctly, the laser will keep shining at the center of the cue ball while it is moving towards the target. If the cue ball goes to either side of the laser when moving, the player will realize that there was something wrong with their stroke. They have failed to cue on a straight line and deflected from it. The amount of deflection from the trajectory is proportional and related to the deflection of the cue ball from the line of laser, and the direction of the deflection of cueing is the opposite direction of departure of the cue ball from the straight laser line.

It is therefore an object of the present invention to provide a holder for the line laser generator to place the laser in such a way that is perpendicular to the table at the upper most position so that the player can easily find the correct line of aim and adjust it while having the full picture of how the shot will be played out. By simultaneously illuminating the cue ball, the object ball (target position), and the table with fully defined straight line between the two points, it eliminates the guessing process that is used for pointing the cue towards the center of the cue ball and to the object.

It is another object of the present invention that can be used to practice and explain different cutting angles, for example, ⅓ ball, ½ ball, etc. The laser line generator can be used to judge cushion first shots or bank shots, where either the cue ball or the object ball hits the opposite cushion first. In this manner, it can help judging the angles and learning the table geometry.

It is another object of the present invention to provide feedback that shows the direction of the cue, flaws and imperfections while cueing, the movement of the hand, the rotation of the grip, the imperfections of the follow through, and several other aspects of the delivery and gives considerable insight to the player so that the player can adjust and make corrections more easily by seeing the course of the ball.

It is another object of the present invention that by shining a vertical line or part of vertical line pattern on to the cue ball, it helps the player to find the center of the cue ball where the line is biggest in size. This helps with another common mistake of players when they put side spin when hitting the ball. If the ball is struck at the center, there will not be any side spin on the cue ball and the cue ball trajectory will be straight. However, if the cue ball is struck at a point which is not along the central axis of the cue ball, the ball will be kicked to the opposite side and starts spinning. The kick and the spin make the ball to have a not straight trajectory and is a common problem for players with various skill levels, especially with novice players who plays the shots with "unwanted sidespin".

It is another object of the present invention that if occasionally hitting a side spin shot is desired for positional play, it can be used to aim the vertical line at the desired location of the cue ball. The end of the line should be parallel to the original center ball striking of the cue ball when hitting the same target. The laser line will be adjusted by positioning the cue on the parallel line to the original line shot by shifting the cue to the desired side.

It is further another object of the present invention to estimate the trajectory of the cue ball after hitting the object ball. After the cue ball hits the object ball and send the object ball on the desired path, the cue ball also moves to another position. The trajectory of the path that cue ball is taking is much easier to judge and understand with the present device.

It is another object of the present invention that is portable and designed to be used by being attached to regular, personal or club cue. It can be used to practice straight cueing and aiming on the billiard tables or hit imaginary ball and aim at an imaginary object at home by use it at any other location that has the same height as a billiard table.

It is another object of the present invention to make the notoriously hard games such as Snooker much easier and fun because the chance of making pots becomes higher and can use this device to confidently pot balls, in the meantime and focus on other aspects of the game, like positional play.

It is another object of the present invention to provide a device that can be used for training a variety of sports including but not limited to sports such as Billiards, Snooker, Golf, Hockey, Curling, Bowling and also has application to sports that have a 3D movement of the ball.

It is another object of the present invention to provide a training device that can help the player to get the right timing of the shot by following the designed cycles. the player will know how to move the cue and their body at different timepoints during the strike and therefore establishing a routine in their striking.

BRIEF DESCRIPTION OF THE DRAWINGS

Embodiments hereinafter will be described in conjunction with the appended drawings provided to illustrate and not to limit the scope of the claims, wherein like designations denote like elements, and in which:

DETAILED DESCRIPTION OF PREFERRED EMBODIMENTS

Figure 1:
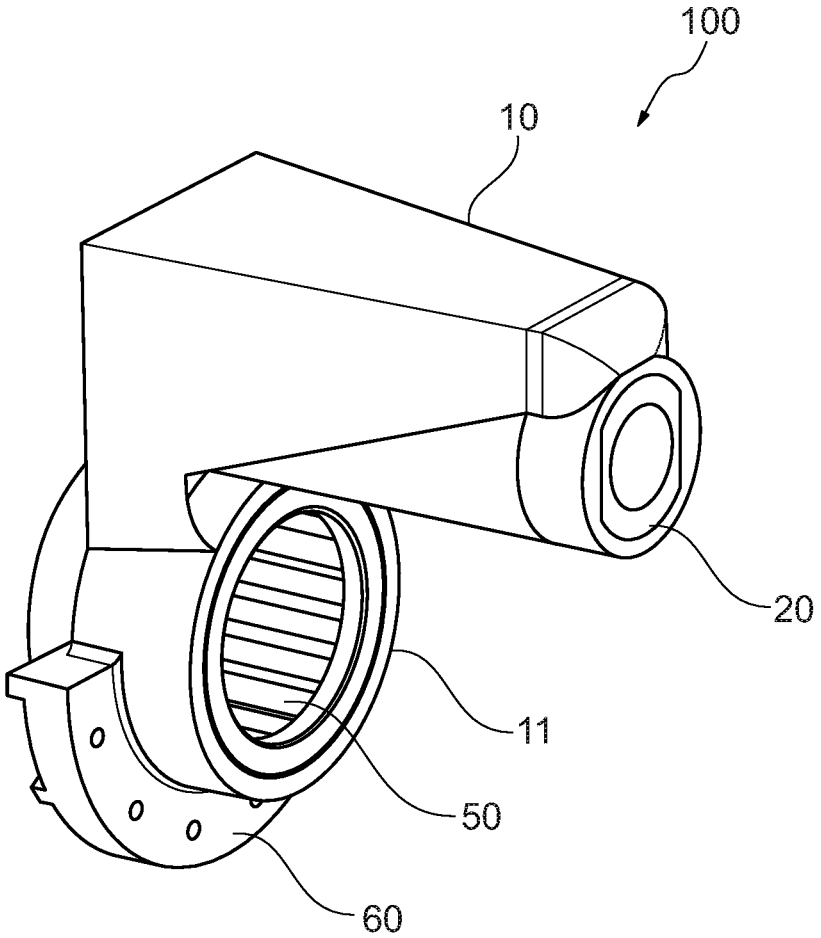
FIG. 1 is a perspective view of the training device for cue sports of the present invention.
Figure 2A:
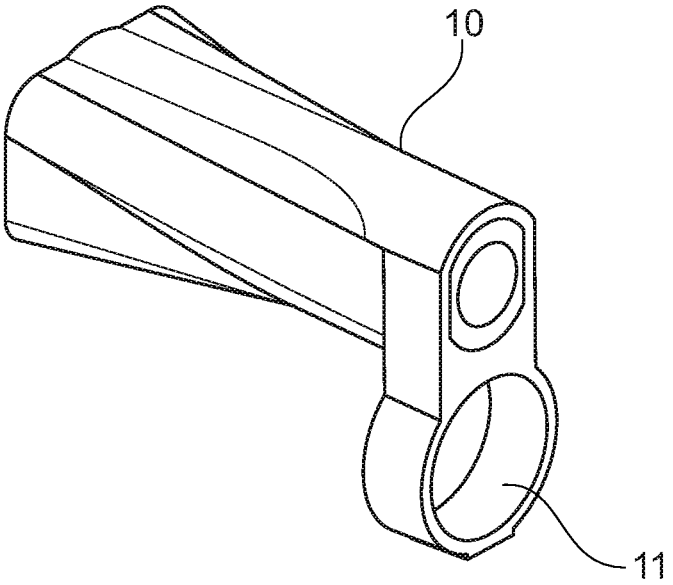
FIG. 2A is a perspective view of the laser line generator holder of the present invention.

FIGS. 1 to 3 show the removeable training and aiming device of the present invention 100 to be mounted on a cue. A cue usually has a length, a butt and a tip. The device 100 comprises a holder 10 to allow the cue to be placed in any orientation along its vertical axis and components of the device to be mounted thereon.

The holder 10 can be an injected moulded plastic part, 3D printed, or a machined light weight metal like aluminium with cavities to receive various components of the device 100. The holder 10 has a ring 11 at the bottom part that has a 16-22 mm diameter for installation on the cue. The ring can also have a gasket inside the inner diameter of the pivot mechanism for better attachment to the cue. The holder 10 slides in to position from the tip of the cue or can be tightened over the cue by using a clamping mechanism. In the simplest form, since the cue usually has a conical shape with smallest diameter at the tip and largest diameter at its butt, the holder can be slid into the place from the tip of the cue.

Figure 2B:
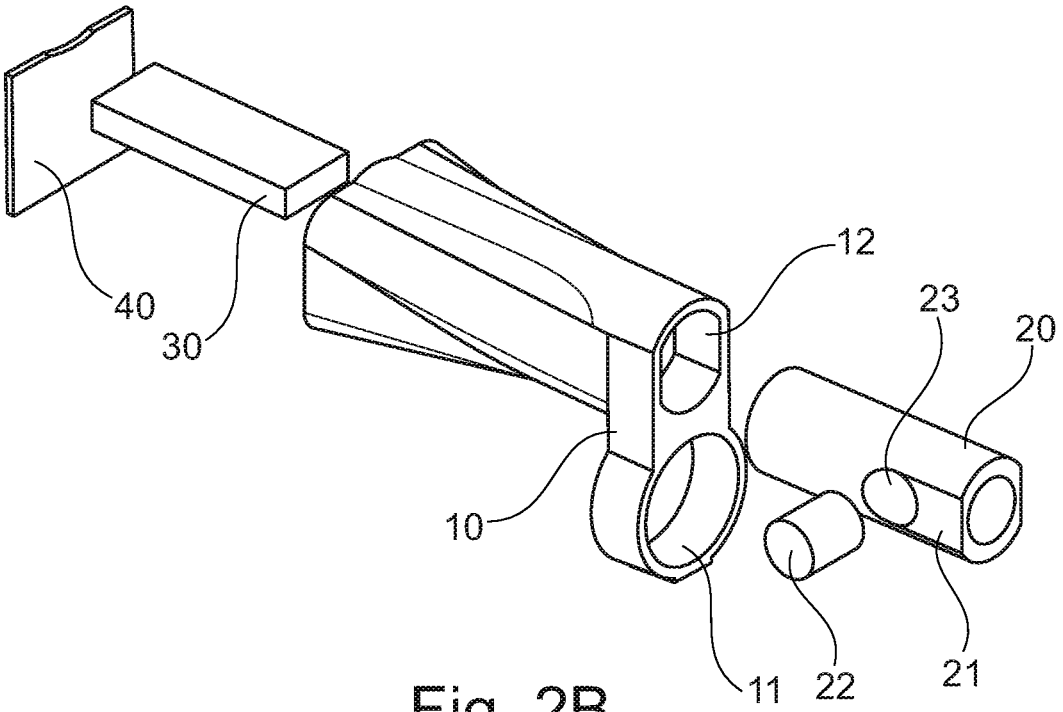
FIG. 2B is an exploded view showing the major parts of the present invention.

FIG. 2B shows different essential components of the device, which comprise of a laser module 20 which is inserted into a cavity 12 of the holder. The body of the laser module 20 may have 2 guiding features 21 (shown only on one side) provided on either sides of the laser module 20 to slide into the holder 10 in a precise way so that it remains vertical. Alternatively, the laser module 20 can have adjustment knobs to rotate and align the laser with the body of the holder 10. The laser module 20 has a laser installed at its distal end. The laser is preferable red (600-650 nm) or green (500-600 nm) but it can be of other colours as well.

A cylindrical lens 22 is inserted into an aperture 23 in front of the laser beam to form a planar laser fan which has a fan angle or a cross shaped laser beam with a predefined width on a playing surface. The angle of the laser module 20 inside the holder 10 and the laser fan angle is in such a combination that when the player is on the shot and is striking the balls, the laser does not shine above the table level which is a safety feature to not allow unwanted illumination onto other people that are walking or standing around the tables or other observers.

The lens 22 can be a glass cylindrical lens, a biconvex, biconcave, plano convex, plano concave or any PMMA patterned lens (line pattern, cross pattern, circular pattern), or other lenses that generate a laser sheet, a line or a cross pattern. Optionally, guiding features 21 extend to the line generator lens 22, so that when the lens 22 is inserted into the laser module 20, the linear exposure profile remain perfectly vertical, which helps with the assembly without the need to use alignment knobs and make sure that the line remains precisely vertical with respect to the body of the laser module 20. The cavity of the holder 12 at its top front part provides cavities that matches the guiding features 21 on the laser for easy installation by sliding in position.

Referring to FIG. 2B again the holder 10 further has an opening on its rear portion to receive a battery 30 to provide power to the device and a PCB control board 40. The battery 30 can be a rechargeable battery that is charged by connecting to an outlet with a USB cable. The PCB control board 40 is programmed to implement different functions of the device 100 and automatically balance the laser on the top of the cue, so that the planar laser fan is always aligned along the length of the cue. The control board 40 provide an on and off button; a multimode button that controls different programming duty cycles of the laser, a tilt sensor with different applications to find the orientation of the cue, and connects or disconnects the laser power based on the sensor input. This feature provide safety to avoid exposure of the laser when the cue is not held horizontally (on the shot). It also helps to save battery power by disconnecting the laser when the cue is not held horizontally (the cue is not on the shot). Moreover, with different duty cycles, the control board 40 is programmed to offer different on and off periods to establish a pre-shot routine for the player.

Figure 3A:
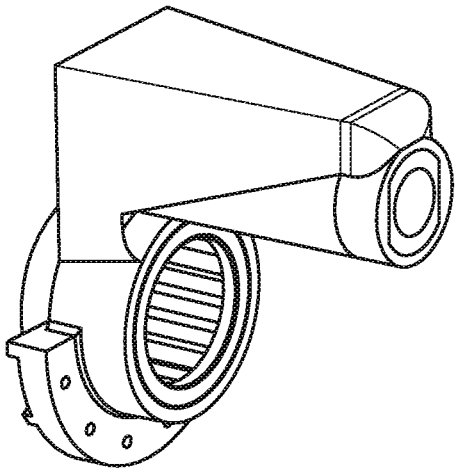
FIG. 3A is a perspective view of the present invention.
Figure 3B:
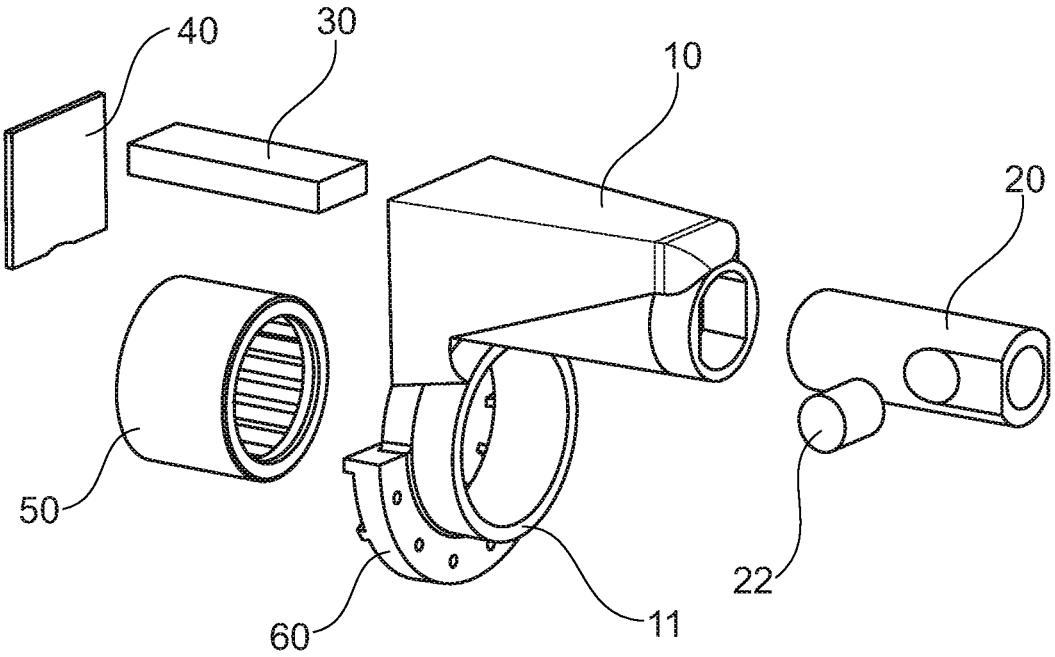
FIG. 3B is an exploded view showing the self-balancing system of the present invention.

As shown in FIGS. 3A and 3B the training device of the present invention 100 provide a self-balancing system which is achieved by a suspension unit and a counterweight unit. The suspension unit is a bearing 50 provided on the inner portion of the ring 11 of the holder 10 to allow the cue to be placed in the ring and rotate therein and the counterweight unit comprises of a weight or weights 60 attached to the bottom of the ring 11 in a manner to enhance a self-balancing system to the device 100. The bearing 50 is selected from stainless steel, chrome or ceramic bearings which is press-fitted, glued or attached by any other attaching means to the inner portion of the ring 11. The bearing has the inner diameter to hold the cue tight (preferably 16 mm to 22 mm inner diameter, that corresponds to ¼ to ½ of the cues length) and has an outer diameter that is preferably as thin as possible. The outer diameter of the bearing 50 is chosen to be fitted inside the ring 11 of the holder. The holder 10 slides into position from the tip of the cue. The draft on the cue helps to get a tight fit and precise fit on the holder 10.

The self-balancing system enables the device to remain upright on the cue. This orientation will be maintained no matter how the cue is initially held, because the counterweight 60 always pulls onto the holder 10 and the laser module 20 which is placed oppositely from the counterweight 60 will go to the top of the rotation and stays there. Placing the laser module 20 in such a way that is perpendicular to the table at the upper most position is critically important. If the laser module 20 is not at the top, the line that is illuminated on the table is not in the same direction as the line from the centre axis of the cue, so it does not represent the direction of force that the cue is applying to the cue ball when striking it.

The weight 60 is made out of a material which is much heavier than the rest of the holder 10, such as stainless steel, or even tungsten to have higher compactness. The weight 60 is chosen such that the centre of the mass of the holder 10, laser 20 and weight 60 combination falls lower than the centre of the bearing 50 so that the laser 20 stays in an upright position. Moreover, it is designed in such a way that it does not hang much lower than the holder 10 (maximum 5 cm) to avoid colliding with the playing table when cueing. The weight 60 is attached to the holder 10 by using metal or plastic fastening methods such as press-fit, gluing, screw, nut, or permanent rivets.

The self-balancing system of the holder orients the laser properly and effortlessly before every shot. This will be achieved by the design parameters of the bearing 50 and the weight 60. If the bearing inner diameter is denoted by r, and the centre of the mass of the weight is at a distance R from the centre axis of the cue, the ratio R/r is important for the dynamic rotation of the laser 20 to counter any rotation of the cue. Another important factors include the friction of the bearing 50, and the ratio of the masses of everything above the bearing 50, including the laser 20, the holder 10, the battery 30 and the PCB control board 40 denoted by m and the mass of the weight 60 denoted by M. The requirement for the balance to work is M>m. In one embodiment, the total mass of the laser, the holder, the battery and the PCM control board is around 20±7 g, and the counter weight 45±14 g. The radius r was 16-22 mm and R was 26-45 mm, with optimal playability and rotation dynamics achieved with r=17 and R=34 mm.

Moreover, the ratio, coupled with the friction coefficient of the bearing 50, and the R/r ratio, determines the speed with which the correction to rotation takes place. A very large R, a low friction bearing 50, and a relatively large M, results in high stability of the laser module 20 and any rotation of the cue along its axis will not affect the laser 20. However, a high friction, a smaller M, or a smaller R, results in some rotation of the laser 20 along the axis. Depending on the purpose of the device 100, these values can be tuned. If the rotations are preferred to be detected to show flaws in the movement of the player, one set of variables are chosen. However, if stability is required and only the line of shot is important or a camera is placed instead of the laser, another set of parameters, which gives more stability is used. Without the self-balancing holder, the illuminated line will not coincide with the line shot or the trajectory of the cue ball after being hit by the cue. Manually orienting the laser can be flawed, tedious, and inaccurate because of misjudgment of the player, and impossible due to player's wrist rotation during delivery.

Figure 4A:
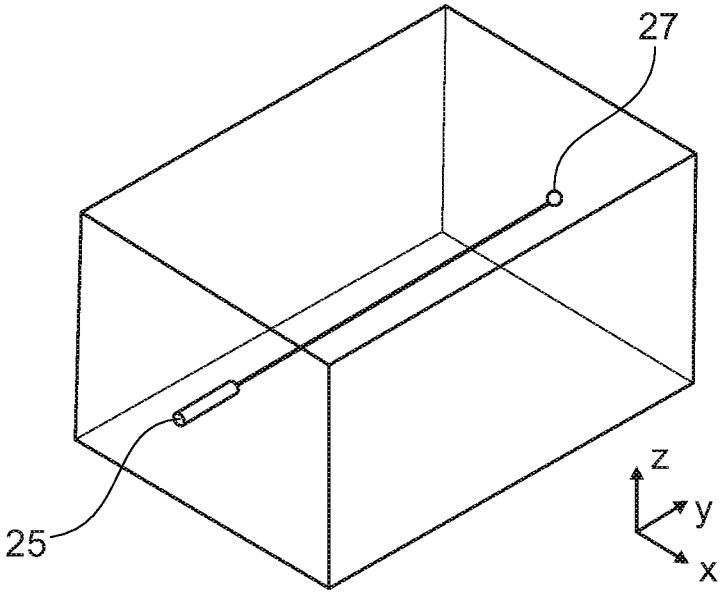
FIG. 4A shows a dot pattern laser without the line generator lens.
Figure 4B:
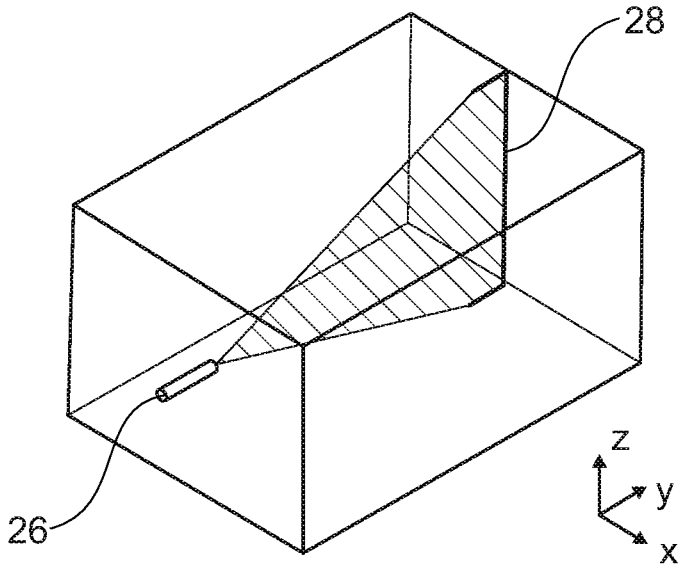
FIG. 4B shows a line pattern laser with the line generator lens.

FIG. 4A shows a laser without line generator lens 25 which generated a dot pattern 27. FIG. 4B illustrates laser with line generator lens 26 that forms a laser sheet and a line pattern 28. The y-x plane represents the playing surface or field. The line generator lens may be, but not restricted, to PMMA lens, glass cylindrical lens, or Powell lens. By shining a vertical sheet onto the cue ball, a line pattern 28 is formed that helps the player to find the center of the cue ball where the line is longest. The laser sheet passing through the center of the ball will always have the longest length since it is passing through the whole diameter of the ball. This helps with another common mistake of players when they put side spin when hitting the ball. If the ball is struck at the center, there will not be any side spin on the cue ball and the cue ball trajectory will be straight.

Figure 5A:
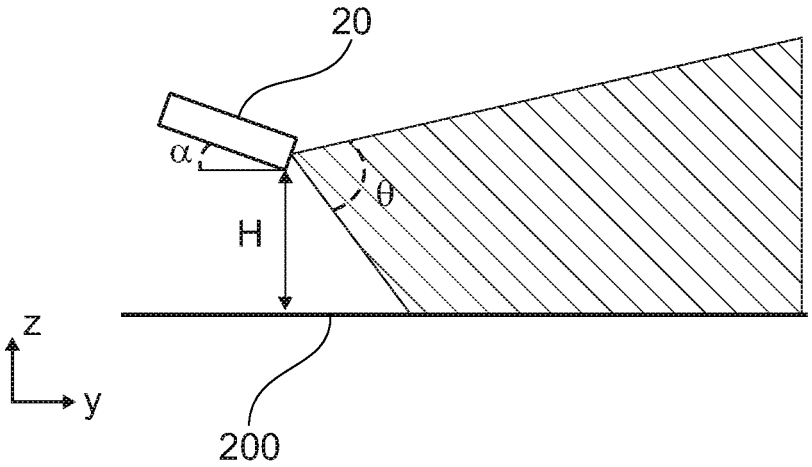
FIG. 5A illustrates the positioning of the laser line generator of the present invention.
Figure 5B:
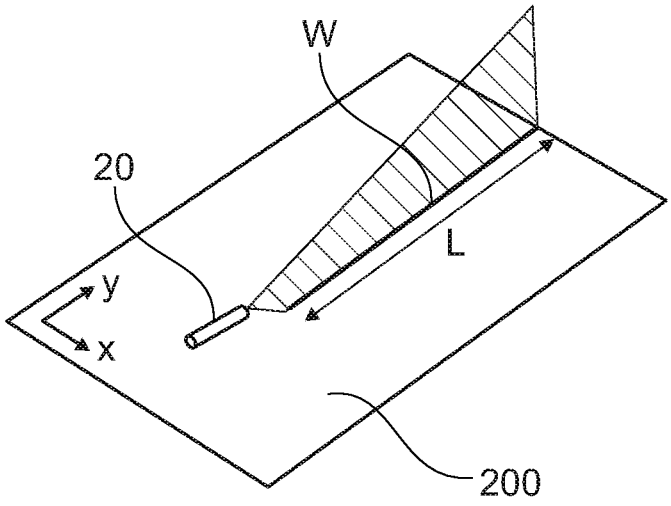
FIG. 5B illustrates the laser line generated on the playing field.

FIGS. 5A and 5B show important design aspects of the laser module 20 and its positioning. Referring to FIG. 5A $\alpha$ is the angle of holding the laser 20 with respect to the playing field 200. $\theta$ is the fan angle or emission angle of the laser 20 which is governed by the line generator lens used. H is the distance of the laser 20 with respect to the playing ground 200. FIG. 5B shows an illustration of the laser generated line shining on the playing field 200. The length L of the line depends on the angle of holding the laser generator 20 with respect to the playing field 200 and width w of the line, depends on the intensity of the laser and the type of lens used. The laser 20 can be placed onto the holder 10 in such a way that in the normal striking position, it shines the line onto the ground or playing field 200. The holder 10 is placed onto the cue and the player is required to hold the cue in such a way that the holder 10 remains at the top of the cue so that the line that shines on the table is perpendicular to the table and is in the direction straight from the cue.

Figure 6:
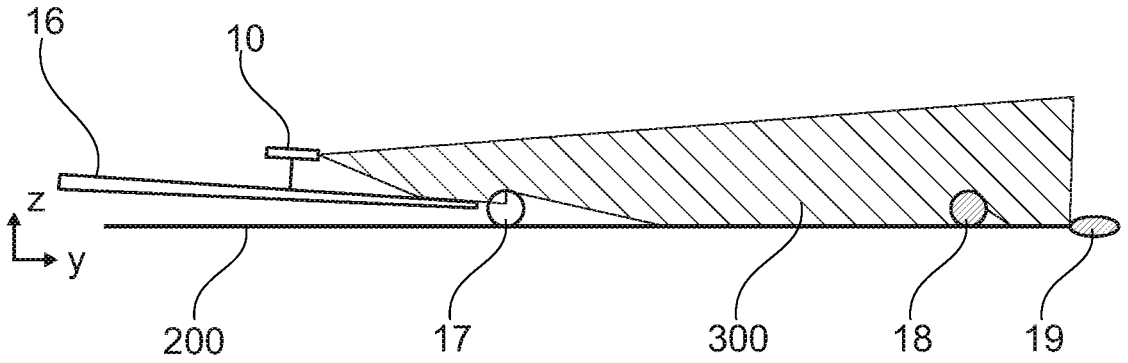
FIG. 6 illustrates using the present invention as a guideline for cue sports.
Figure 7:
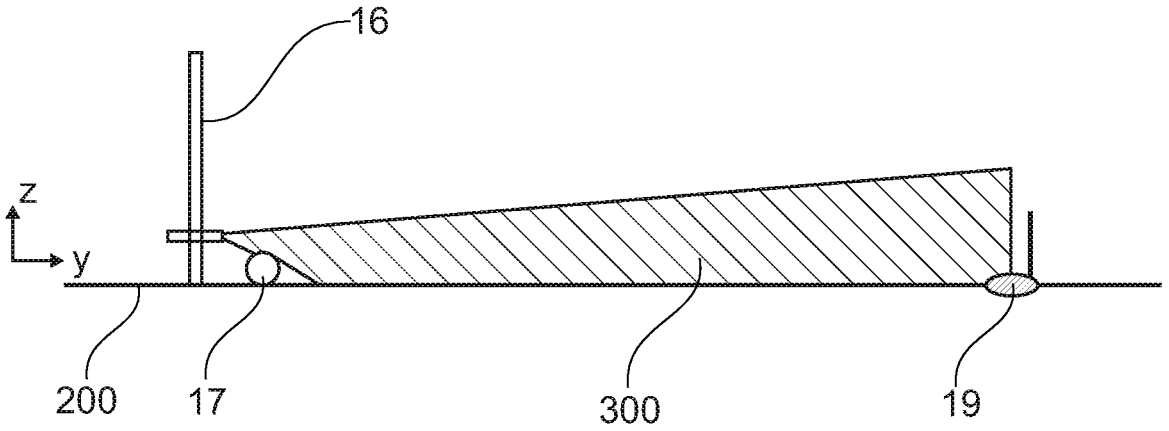
FIG. 7 illustrates using the present invention as a guideline for aiming practice in hockey or golf.

FIG. 6 and FIG. 7 illustrate application of the present invention in the sports of snooker and golf, respectively. The laser generator holder 10 is placed on a cue 16 for aiming guide in snooker or other cue sports as shown in FIG. 6 or in a golf club on a hockey stick for aiming practice in hockey or golf as shown in FIG. 7. The laser generator holder 10 is placed in such a way that it shines a light on to the playing field 200 for example snooker table. The laser generator holder 10 is also aligned with the cue 16 in such a way that the force that the cue 16 exerts on the cue ball 17 is exactly in the same direction as the direction of laser exposure 300. In this scenario, after striking the cue ball 17 it moves on the direction that the line 300 is showing. The aiming direction is visible by simultaneously shining the line 300 on the cue's central axis 16, the cue ball 17, and the target ball 18, and shows that the aim coincides with the centre of the cue ball 17 and the target ball 18 or pocket 19.

Figure 8A:
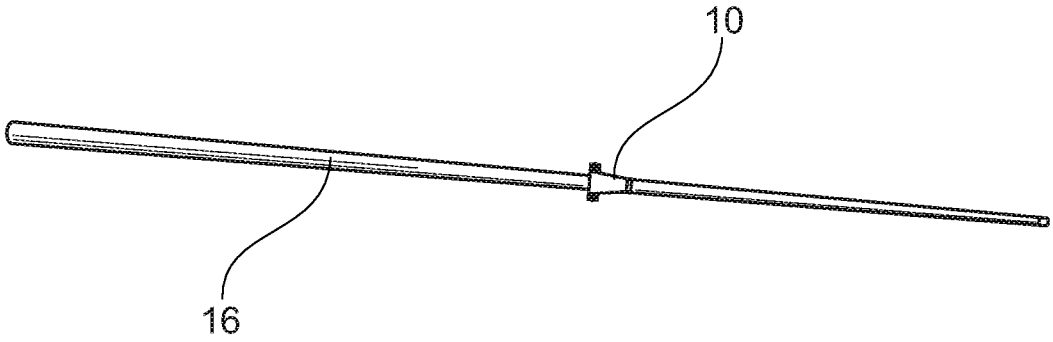
FIG. 8A shows the placement of the present invention on the cue.
Figure 8B:
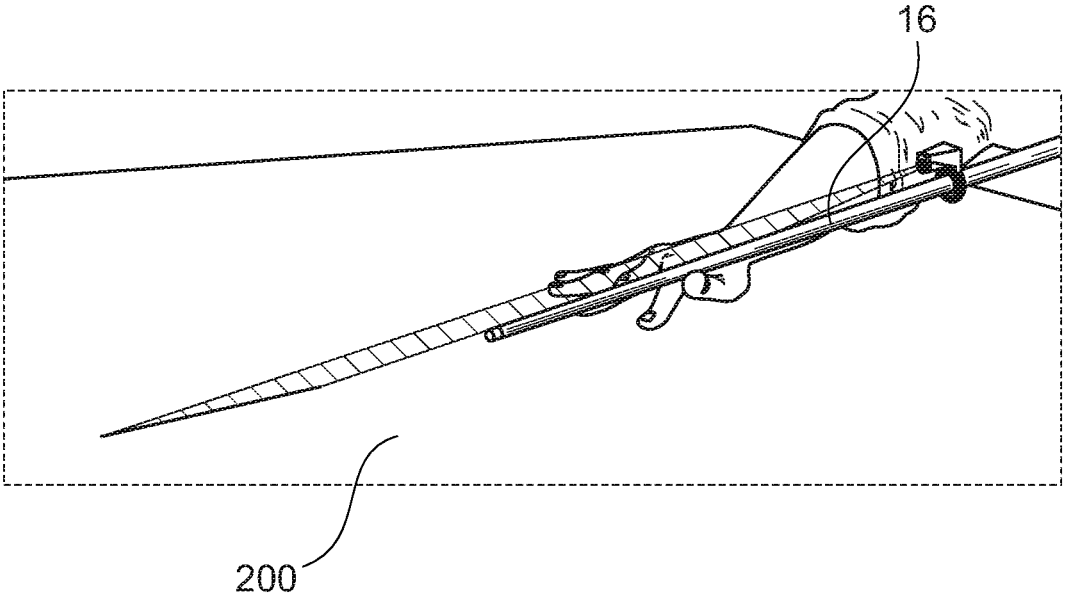
FIG. 8B shows the present invention in use by a player.

FIGS. 8A and 8B show the holder's placement. The laser holder 10 is designed in such a way that when it resides on to the cue 16, it places the laser line generator 20 or cross pattern generator at slightly higher height than the tip of the cue itself. When the cue 16 is held, for striking, usually it is held at a slight degree with respect to the table playing surface 200, with the tilt angle ranging from a few degrees to tens of degrees. Since the laser line generator 20 is placed at slightly higher place as the tip and it is tilted downward, it will shine the line pattern both on to the cue ball and the target ball.

The laser holder 10 is placed in a place that does not interfere with regular play. For most cue sports, this place is around ¼ to ½ of the cue length from its tip. This place is chosen such that it is far enough from the tip to allow regular bridge formation and cueing, but not too far to interfere with the placement of the head on to the cue for sighting. For example, on a snooker cue, it is positioned around the centre point of the cue length. In this manner, it does not interfere with the bridge hand and follow-through, nor it interfere with the rest of the body that is trying to hold the cue on all the stages of cueing. For each sport such a place should be found so that the placement of the module does not impede the regular usage of the device 100 in the absence of the laser module.

Figure 9:
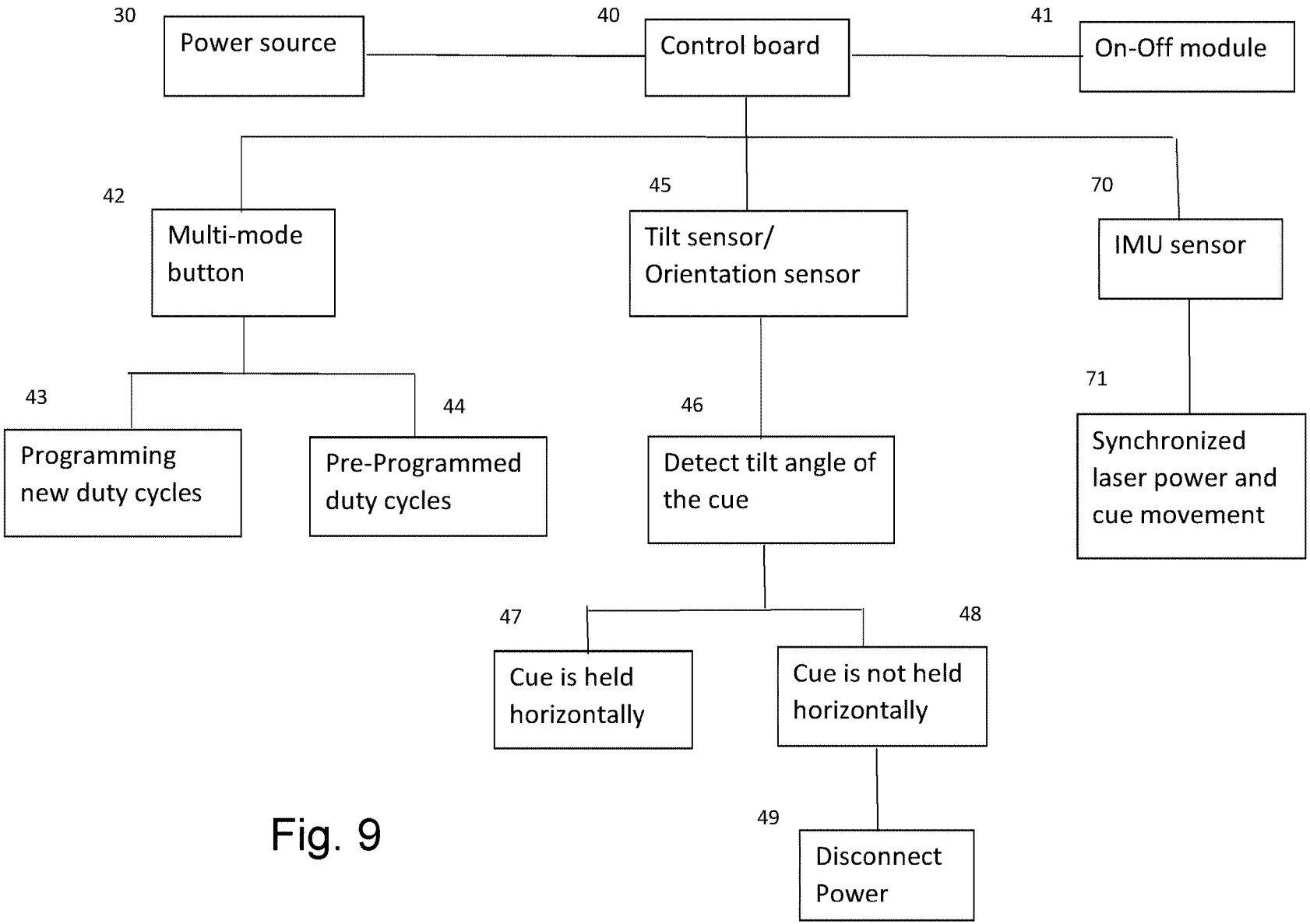
FIG. 9 is a diagram showing the control board of the present invention.

FIG. 9 is a diagram showing the functionality of the control board 40 of the present invention. The control board 40 is programmed to implement different functions of the device 100 and is connected to a power source 30 which can be a rechargeable battery to provide power to the system. A USB and a charging chip are provided for charging the device. The control board further provide an on-off module 41. A multimode button 42 controls different programming of the duty cycles. The multi-mode button controls a set of pre-programmed duty cycles 44 or a set of new duty cycles 43.

The control board 40 is further equipped with tilt sensors and orientation sensors 45 to detect the tilt angle and orientation of the device 46 and connect or disconnect the laser power based on the sensor input. If the cue is held horizontally the laser generator will continue to generate laser 47. If the cue is not held in the right position 48 the laser will be disconnected 49. It also helps to save battery power for example in Snooker, this feature is useful in prolonging the battery life by disconnecting the laser when the cue is not held horizontally.

The control board 40 is programmed to offer different on and off periods to establish a pre-shot routine for the player and can be programmed in such a way that turns on the laser and turn it back based on the sensor input. The control board 40 is further intended to be programmable in such a way that enables different duty cycles based on pre-programmed software or based on the players movement. By tuning the duty cycles or on-and-off periods of the laser, the control board enables using different coaching scenarios.

The control board 40 further provide an inertial measurement sensor (IMU) 70 to synchronize the laser power and the cue movement 71. By tuning the duty cycles or on-and-off periods of the laser module 20, the control board 40 enables using different coaching scenarios. In each coaching scenario, the player is advised to coordinate their movement of hand and thus movement of the cue to match the laser module 20 by on and off periods. For example, when the laser module 20 is on, the cue should go forward and when the laser module 20 is off the cue should be drawn backward. This not only helps the player to keep the cue on the line of shot and deliver the cue in a straight line, but also it helps the player to build up a rhythm and get a reproducible timing for their pre shot routine. Selecting different programmed sensor interpretation data for various duty cycles can be as below:

always on;

on when the player demands it;

on only when the player is on the shot; the sensor data can detect the position of the player and cue and can determine when is the time that the player is on the shot;

or by input data from the on-board IMU sensor which can be coordinated with the laser in such a way that the laser turns on when the cue is moving forward and is turned off when the cue is withdrawn (back swing) or vice versa.

customized duty cycles, with x amount of on time, and y amount of off time, or different x1, x2, x3, . . . on times and y1, y2, y3, . . . off times. The duty cycles can be tuned and pre-programmed based on timing of advanced players or coaches or manually programmed into the device using an app by the player or by pressing the on-board input button; or any combination of the above and mentioned methods or similar methods.

Figure 10A:
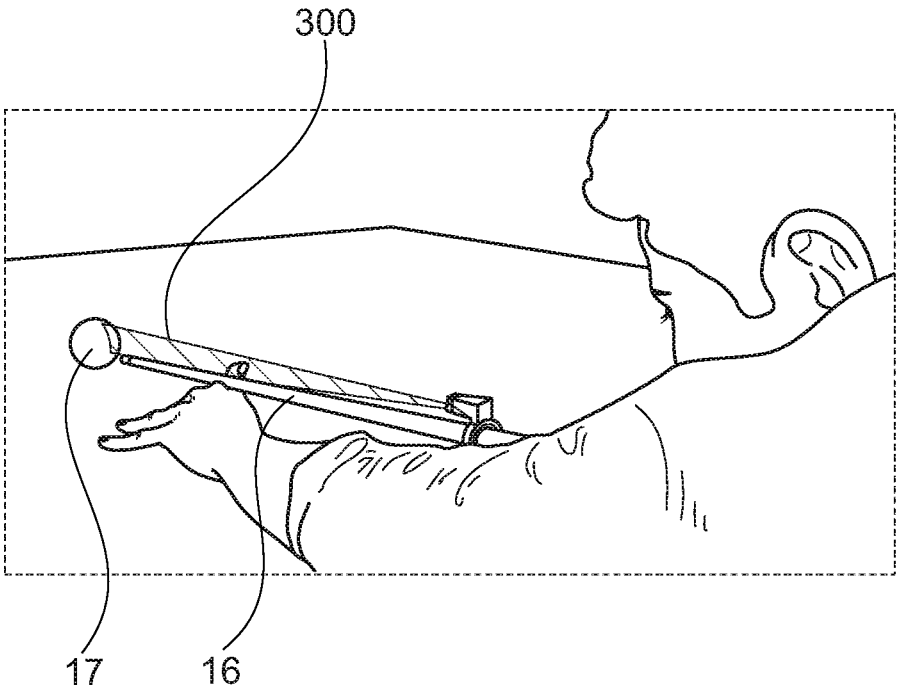
FIG. 10A shows the position of the laser line before the impact.
Figure 10B:
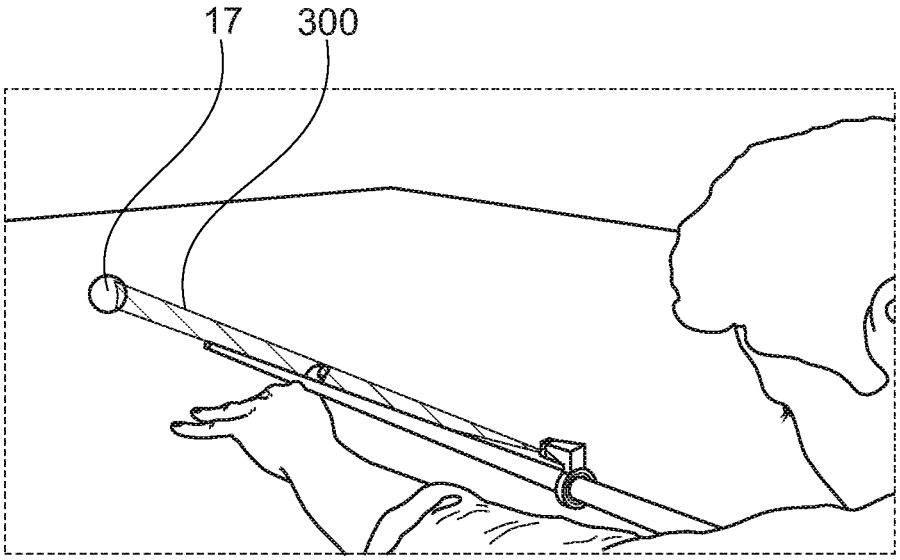
FIG. 10B shows the position of the laser line after playing the shot.

FIGS. 10A and 10B show the position of the laser line before the impact and after playing the shot. When the cue ball 17 remains on the line it shows that the quality of the delivery was good. The player can follow the position of the laser line 300 after playing the shot and see if the ball is following the guiding line or has put unintentional side on the ball. The cue 16 has a semi conical or cylindrical shape. Theoretically, it is possible to hold the cue 16 in any rotation along its longest axis. However, it is always advisable to hold the cue in such a way that the cue's rotation along its main axis is the same.

Most cue 16 have a flat indent at the butt of the cue. Experienced players hold their cue in such a way that the flat indent is facing upward towards the ceiling. However, it is common to unwantedly rotate the cue 16 along its central axis while preparing for the shot or during the execution of the shot. This unwanted rotation is very hard to realize and pinpoint for novice players and they fail to correct their mistake. However, with the laser module 20 placed on top of the cue 16, the laser light is only vertical if it is held in one way as intended. Any other type of holding the cue 16 with rotations along its central axis will cause the laser line not to be vertical anymore. Since the laser line is in front of the player and they always see it while playing the shot, they can easily detect when they have made the unwanted error of rotating the cue and they can make adjustments to make to vertical again.

Figure 11:
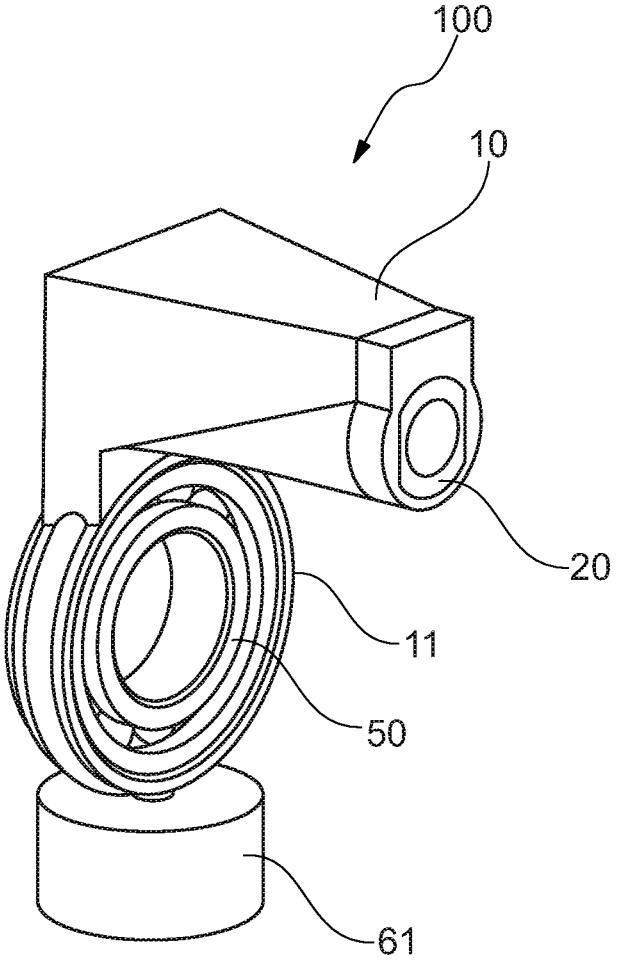
FIG. 11 is a perspective view of another embodiment of the present invention.
Figure 12:
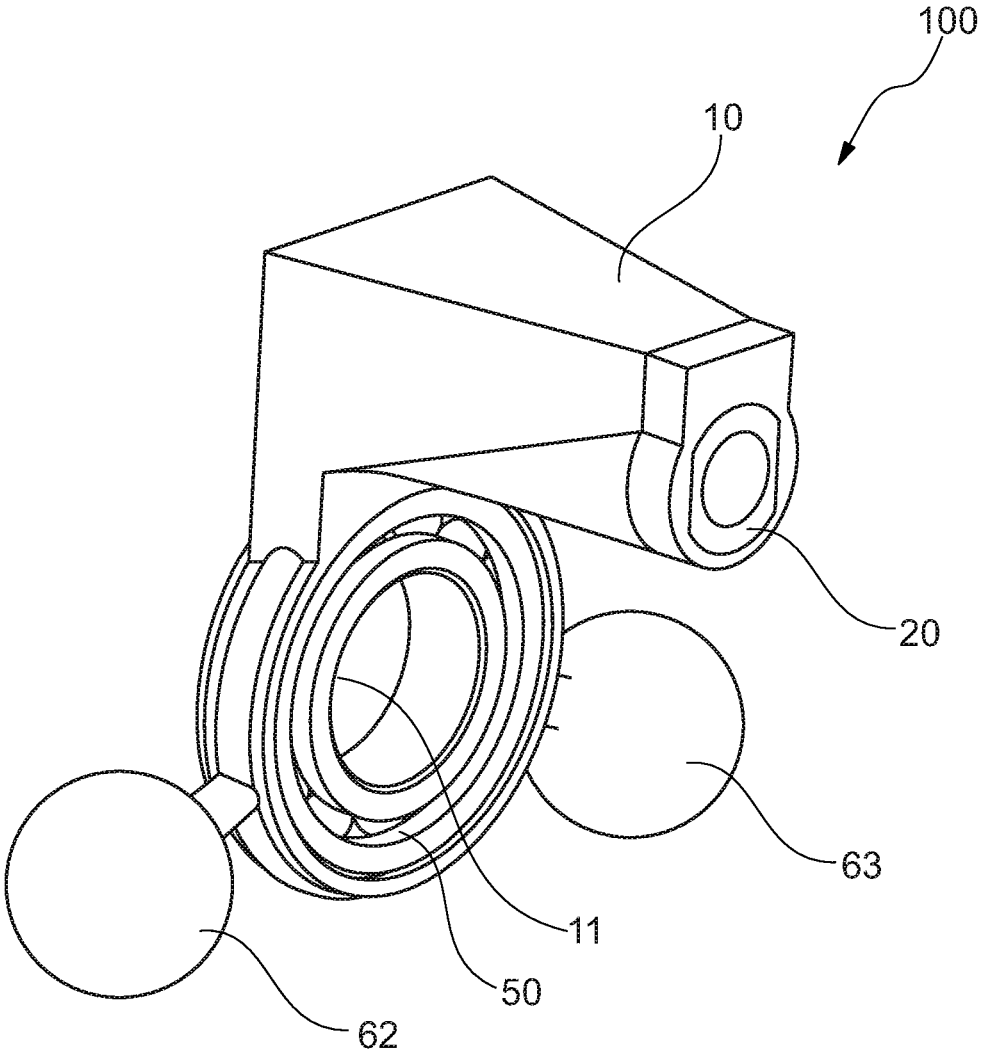
FIG. 12 is a perspective view of another embodiment of the present invention.

FIGS. 11 and 12 show another embodiment of the present invention 100 with different suspension systems. The device 100 has the same components with differences in the weight design. The weight as shown in FIG. 11 is a single weight 61 attached below the holder 10. The advantage of this design is its faster respond to the tilt. FIG. 12 shows another embodiment of the present invention 100 with two weights 62, 63 positioned symmetrically on the either sides of the ring 11 of the holder 10. Since the weights 62, 63 are mounted in an elevation in respect to the holder 10 they can eliminate the chance of collision between the weights 62, 63 and the playing field 200. Any other passive counterweight can also be used. Alternatively, instead of the passive suspension system, a stepper motor controlled with a sensor on the control board 40 can be used to counter the rotations of the cue along its axial direction.

In another embodiment instead of the line laser 20, a camera or any other optical sensor can be used. For example, instead of the laser 20 a small camera can be used which is able to record videos. The suspension system can counter any rotational movements of the cue and dump vibrations of the cue so that the camera recordings become very smooth.

In another embodiment a cue camera can be installed on the holder to record the cueing from the point of view of the cue without vibrations and miss orientations. The shot is recorded on the camera and another player can see what is the exact intention of the player that was playing the shot, and can be a great learning tool for illustrations not only from one player to the other, but from a coach to a player, or from a TV host to the audience.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A training device for cue sports to attach to a cue having a length, a butt with a large diameter, and a tip with a small diameter, the training device comprising:

a. a laser module comprising:

i. a laser to generate a laser beam;

ii. a cylindrical lens placed in front of the laser beam to form a planar laser fan having a fan angle, θ, or a cross shaped laser beam with a predefined width on a playing surface;

b. a control board to control the laser;

c. a holder to hold the laser module at a predefined height, H, and at a predefined angle, α, with respect to the cue, comprising:

i. a body having a front portion, a rear portion, a top portion and a bottom portion;

ii. a cavity on the front portion designed to receive the laser module;

iii. a ring on the bottom portion having an inner surface with an inner diameter, an outer surface with an outer diameter, a top part and a bottom part;

iv. an opening on the rear portion to receive the control board and a power source;

v. a self-balancing system comprising: a suspension unit that is installed on the inner surface of the ring to hold the cue inside the ring while allowing its free rotation and a counterweight unit installed on the bottom part of the ring to keep the device upright on the cue and automatically balance the laser on a top portion of the cue, wherein the planar laser fan is always aligned along the length of the cue;

whereby the training device is set on the cue by sliding the ring of the holder onto the cue from the tip of the cue, and in operation the counterweight unit keeps the laser module in an upright position as the suspension unit allows the training device to freely rotate around the cue, and the laser module emits a line laser both on a cue ball, a target ball and a playing surface as an aiming guide.

2. The training device of claim 1, wherein the suspension unit comprises of a bearing or a ball bearing for a free rotation of the training device around the cue.

3. The training of claim 1, wherein the counterweight unit is a single weight attached to the bottom part of the ring.

4. The training device of claim 1, wherein the counterweight unit is a two-weight unit positioned symmetrically on the outer surface of the ring of the holder.

5. The training device of claim 1, wherein the control board having a multipurpose button for on-off, for selecting between a set of pre-programmed states of the control board, for a set of programming instructions programmed into the control board, and for selecting a laser duty cycle;

whereby the laser duty cycle can be pre-programmed with instructions or synchronized with movements of the cue, movements of a user and coaching scenarios.

6. The training device of claim 1, further having a tilt sensor to turn the laser off when the cue is not in a playing position.

7. The training device of claim 6, wherein the tilt sensor is an inertial measurement unit (IMU) programmable to be coordinated with the laser in such a way that the laser turns on when the cue is moving forward and is turned off when the cue is withdrawn (back swing) or vice versa.

8. The training device of claim 1, wherein the control board comprising a computer-readable medium comprising of a set of computer-executable instructions to perform a software application programmable to implement different functions of the device.

9. The training device of claim 1, wherein the power source is a rechargeable battery.

10. The training device for cue sports of claim 1, wherein said cylindrical lens being selected from a group consisting of a biconvex, biconcave, plano convex, plano concave and PMMA patterned lens that generates a line or cross pattern exposure.

11. The training device of claim 1, wherein the inner diameter of the ring is configured to let the ring tightly locate at a distance of ¼ or ½ of the length of the cue from the tip of the cue, to allow regular bridge formation and cueing.

12. The training device for cue sports of claim 1, wherein the inner diameter of the ring is 16 mm to 22 mm to hold the ring in a position that does not interfere with a play.

13. The training device for cue sports of claim 1, wherein the counterweight unit is made of stainless steel or tungsten.

14. The training device of claim 1, wherein said counterweight unit is attached to the ring by using metal or plastic fastening means comprising of glue, screw, nut, or permanent rivets.

15. The training device of claim 1, wherein said suspension unit is selected from the group consisting of stainless-steel bearing, chrome bearing or ceramic bearings.

* * * * *